United States Patent [19]

Larson

[11] 4,204,587

[45] May 27, 1980

[54] LADDER CONSTRUCTIONS

[75] Inventor: Clayton E. Larson, Brooklyn, N.Y.

[73] Assignee: White Metal Rolling and Stamping Corp., Brooklyn, N.Y.

[21] Appl. No.: 951,068

[22] Filed: Oct. 13, 1978

[51] Int. Cl.[2] ..... E06C 7/08; E06C 7/50

[52] U.S. Cl. ..... 182/228; 182/194; 182/126

[58] Field of Search ..... 182/228, 215, 165–177, 182/194, 126

[56] References Cited

U.S. PATENT DOCUMENTS

| | | | |
|---|---|---|---|
| 2,090,331 | 8/1937 | Kutscheid | 182/175 |
| 3,559,763 | 2/1971 | Stern | 182/228 |

*Primary Examiner*—Reinaldo P. Machado
*Attorney, Agent, or Firm*—Carroll F. Palmer

[57] ABSTRACT

Ladders made of metal comprising first sections of metal channel that intersect second sections of metal channel have the first and second sections joined together without use of rivets or weldings by providing the first sections with pairs of U-shaped cavities, the second sections with tip flanges, fitting the tip flanges, in various ways, into the U-shaped cavities and press forming portions of the first sections against the tip flanges to lock the first and second sections together. Typically, the first sections would be side rails and the second sections, steps, rungs or cross braces.

10 Claims, 41 Drawing Figures

FIG. 1
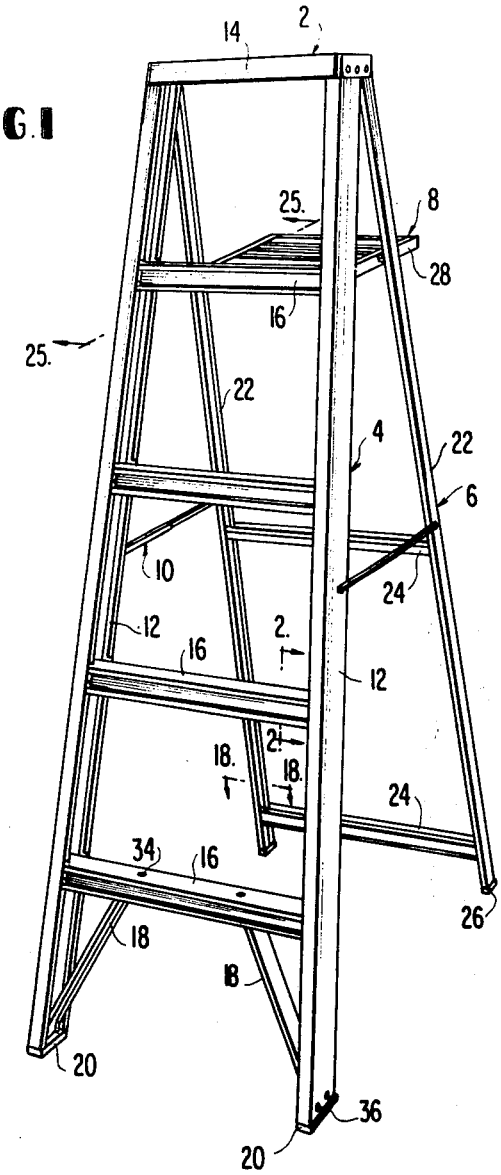
FIG. 2
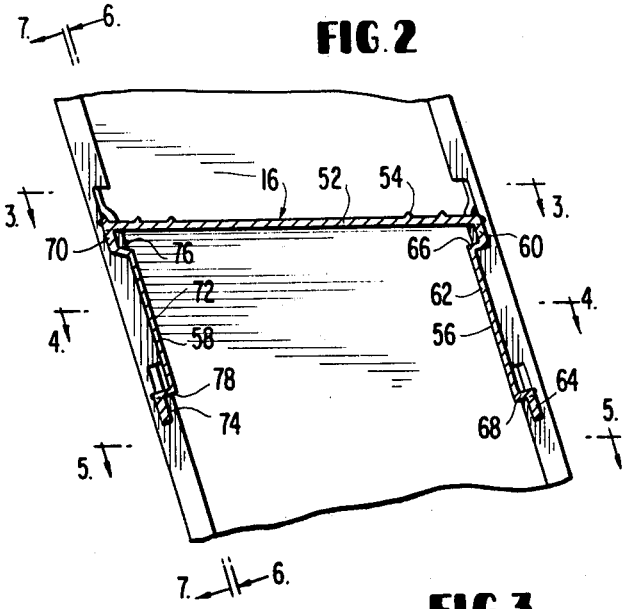
FIG. 3
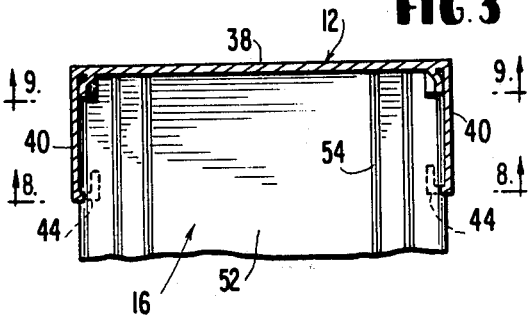
FIG. 4
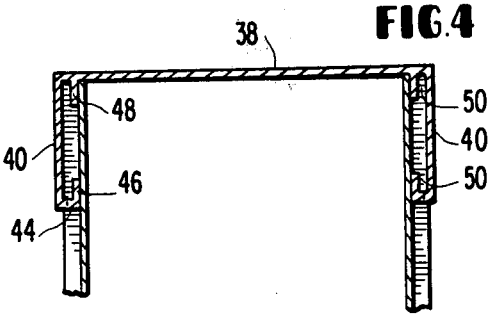
FIG. 6
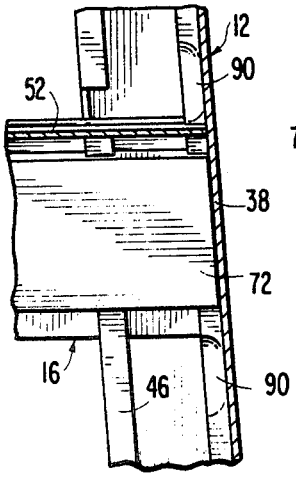
FIG. 7
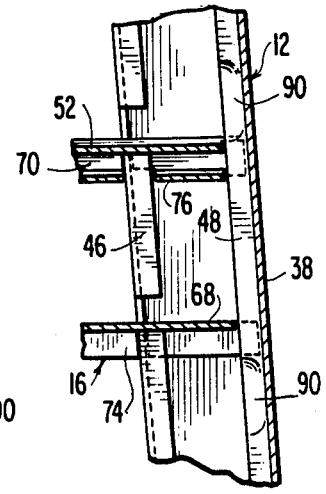
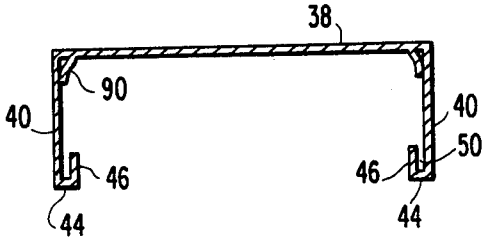
FIG. 5

FIG. 8
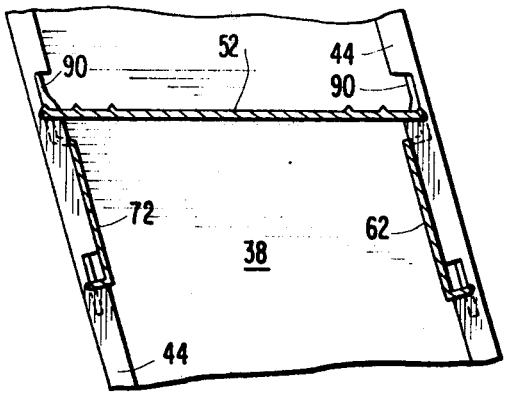
FIG. 9
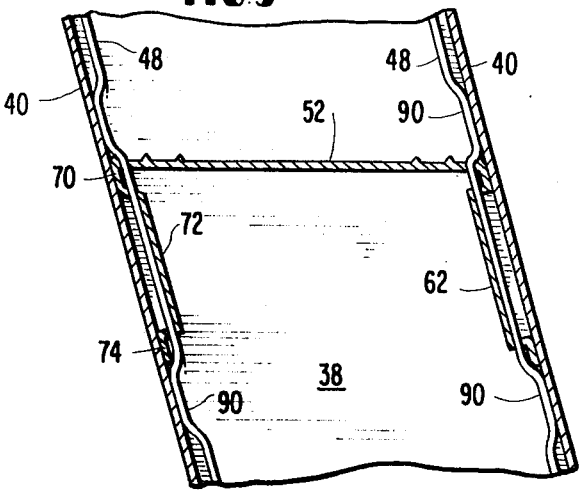
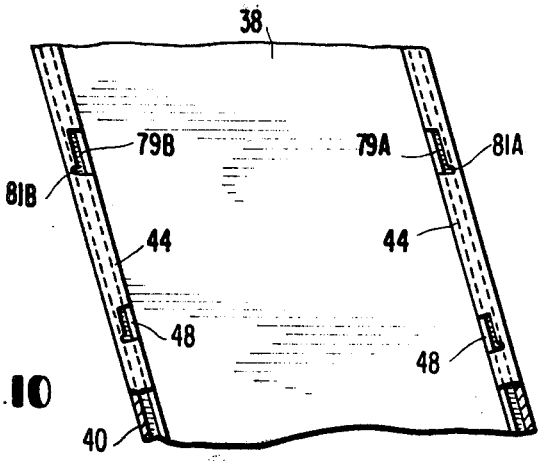
FIG. 10
FIG. 14
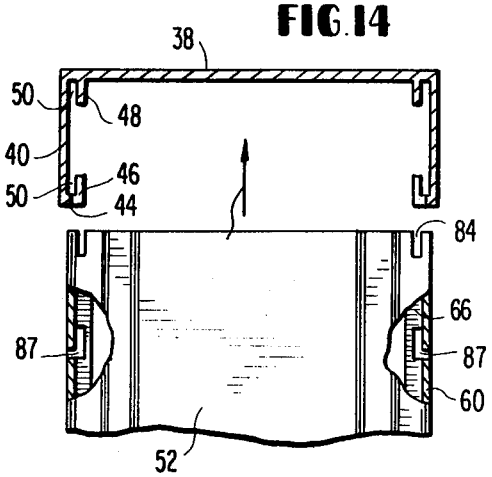
FIG. 15
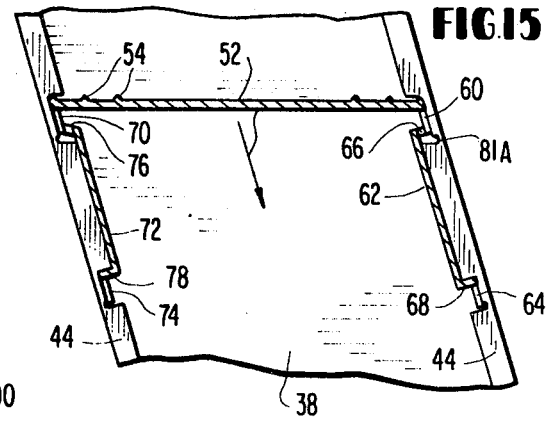
FIG. 16
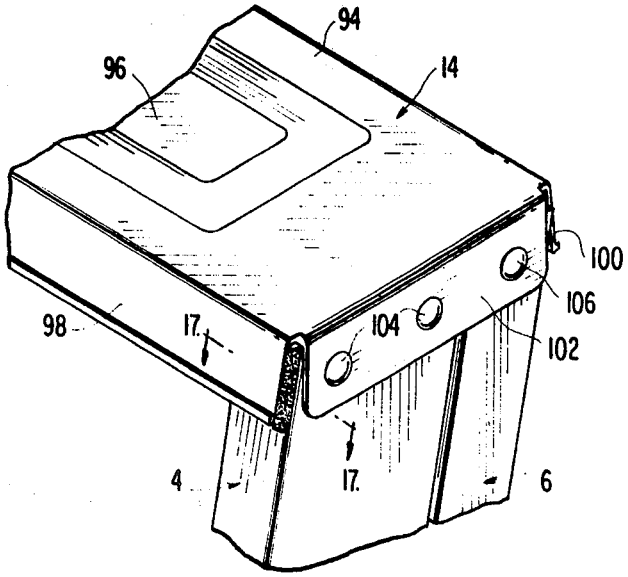
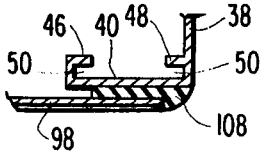
FIG. 17

FIG. 18
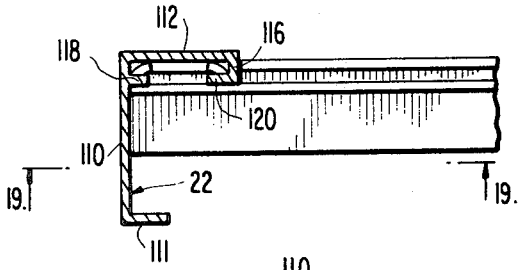
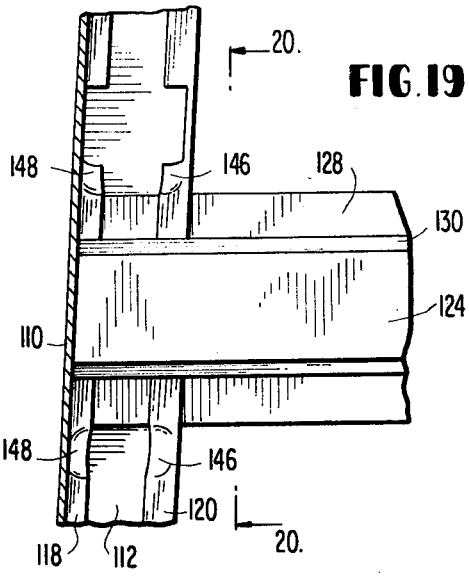
FIG. 19
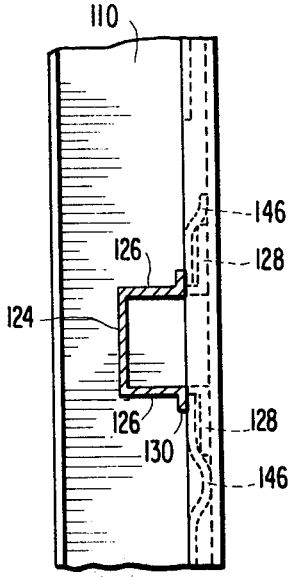
FIG. 20
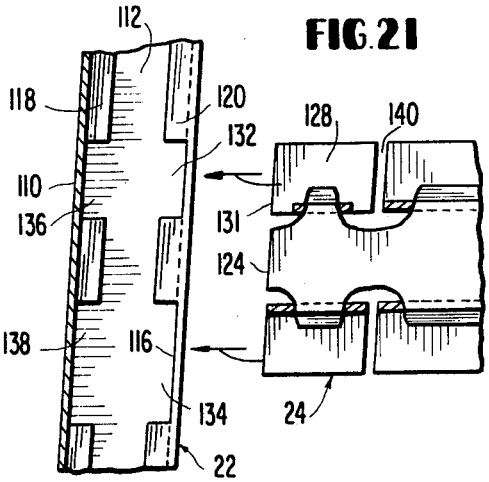
FIG. 21
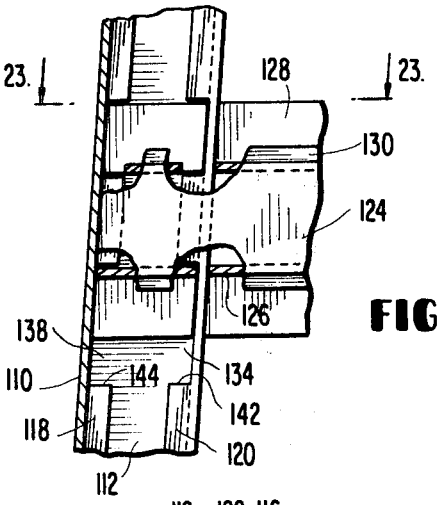
FIG. 22
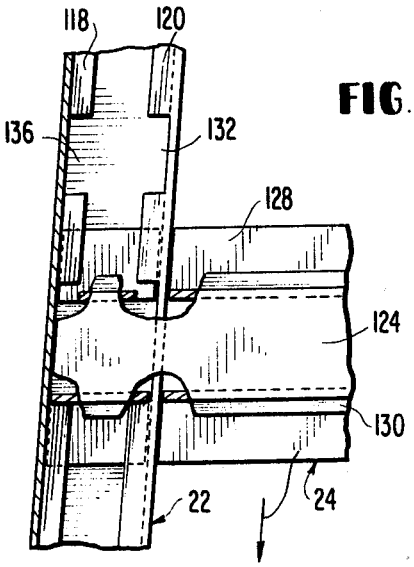
FIG. 24
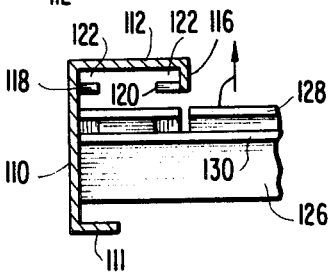
FIG. 23

FIG. 25
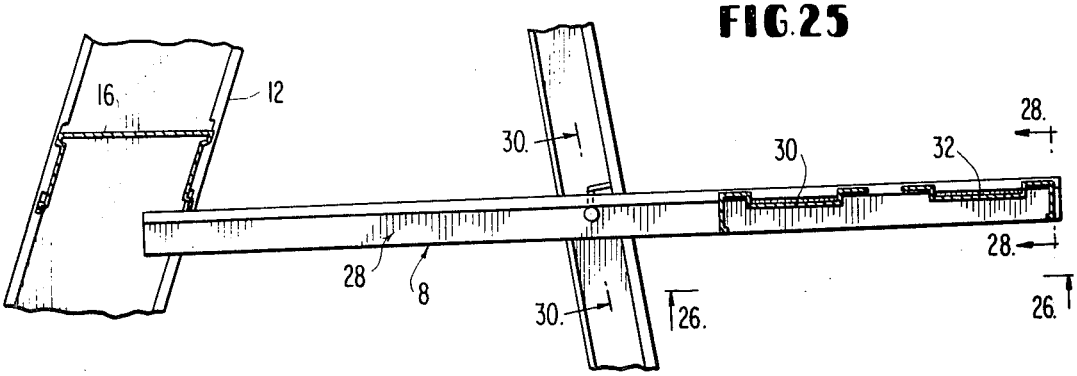
FIG. 26
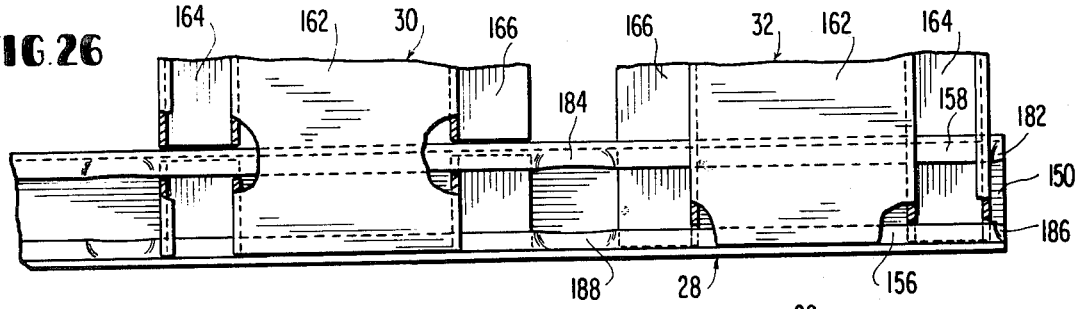
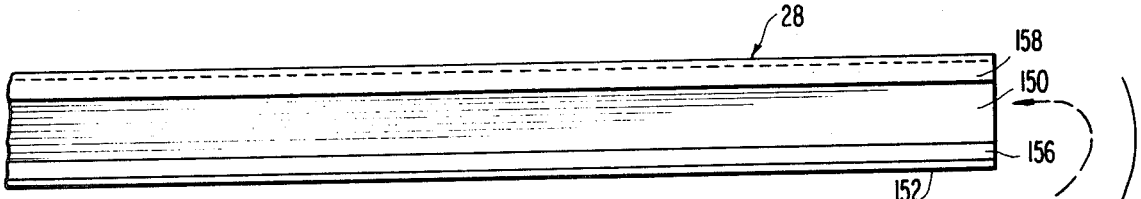
FIG. 27
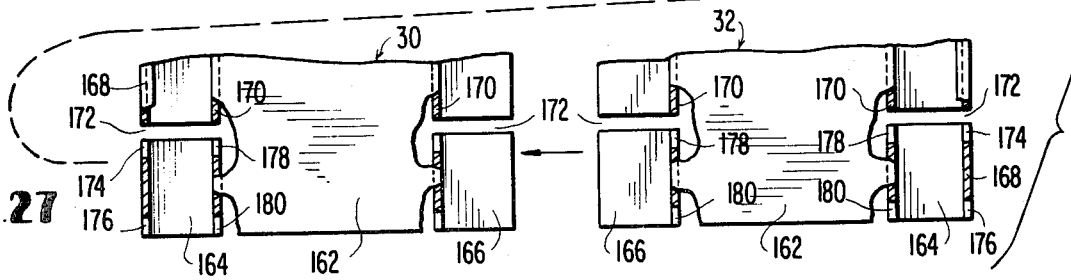
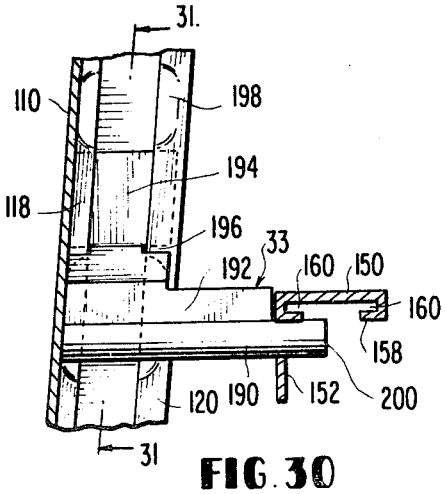
FIG. 30
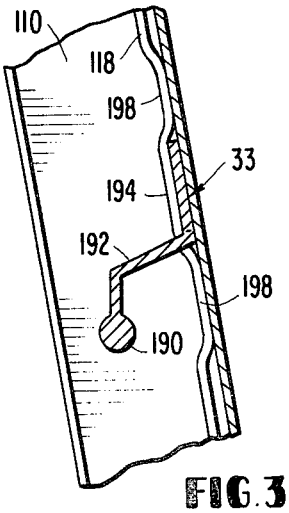
FIG. 31
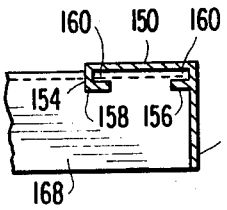
FIG. 28
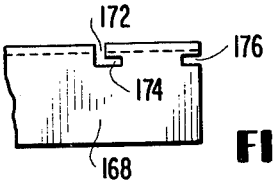
FIG. 29

FIG. 32
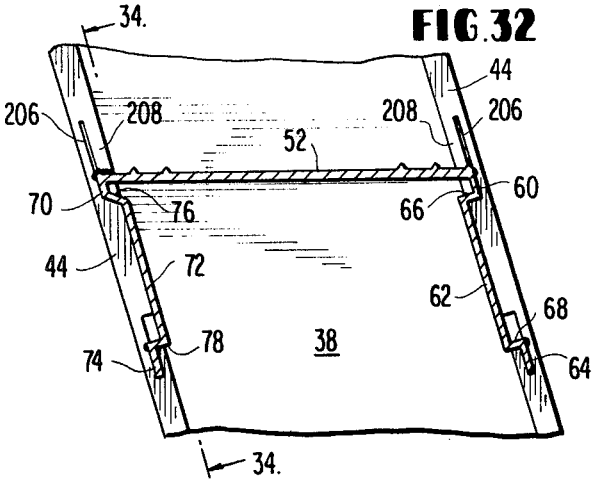
FIG. 33
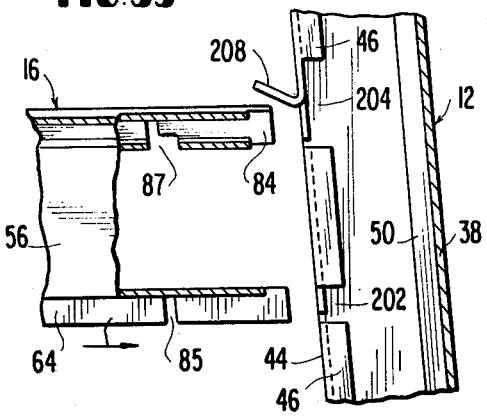
FIG. 34
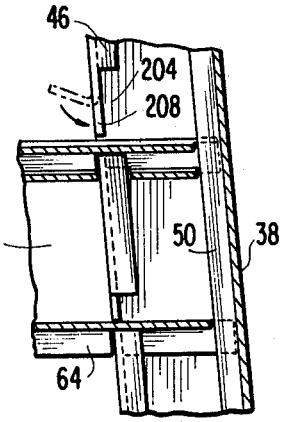
FIG. 35
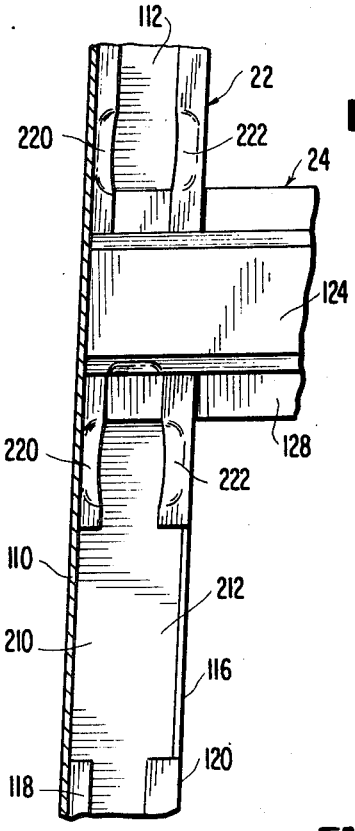
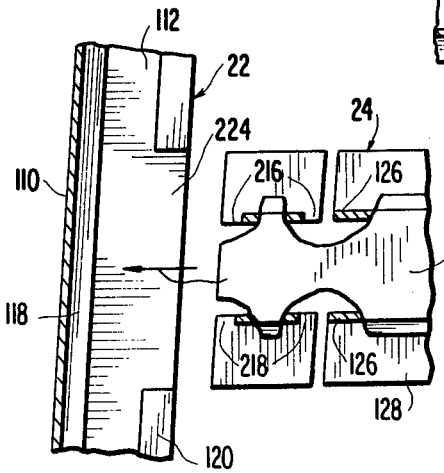
FIG. 37
FIG. 36
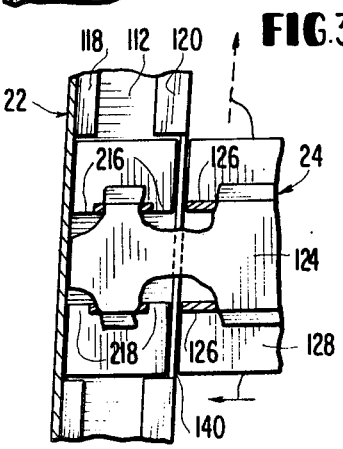
FIG. 38
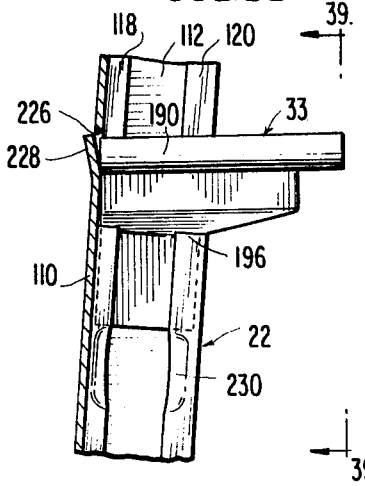
FIG. 39
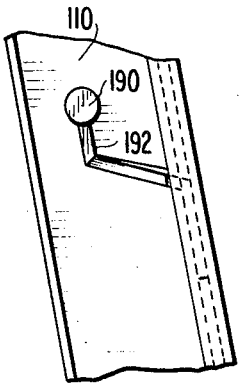

LADDER CONSTRUCTIONS

BACKGROUND OF THE INVENTION

1. Field of the Invention

This invention relates to improvements in ladder constructions. More particularly, it concerns ladders made of metal channel members structured so that there can be interlocking of side rail and cross member elements of the ladders without use of rivets or other separate fasteners and/or welding to provide the interlocking.

2. Description of the Prior Art

Wood has been historically a basic construction material for all types of ladders. Important features desired in all ladders are (1) lightness in weight, (2) great strength, (3) good stability during use and (4) highest safety possible for the ladder user. Use of wood as the construction material seriously limits the maximizing of this combination of features. The development of technology of light metals, particularly magnesium and aluminum alloys, has promoted their use as construction materials for ladders to such extent that wood has been replaced as the main construction material.

Prior to World War II, stepladders were primarily made from wood which allowed, because of its inherent lightness volumetrically, the use of thick sections which were in turn necessary because of the low volumetric strength and perishability of wood as a structural material. As wood was a relatively inexpensive material in the forms used for stepladders, the thick sections did not produce undue burden from a total expense standpoint and greatly contributed to the rigidity as well as joint possibilities in this construction. In order to achieve the desirable joints, the steps were frequently dove-tailed into the siderail and reinforced with steel cross rods or in some cases cleats at the ends of the steps and sometimes in the centers of the steps themselves. These components could then be nailed together securely, or in the case of reinforcing rods, tightened through threaded sections at the ends. Wood, of course, had the disadvantage of low volumetric strength, higher weight for comparable ladders, as well as suseptibility of rot, decay, fire and warpage. There were some aluminum stepladders manufactured in the 1930's and during World War II for industrial and commercial use with sufficiently heavy sections so that torsional and lateral stability could be obtained and corresponding abuse resistance or durability insured. Wood, as well as these heavy duty aluminum stepladders achieved reasonable torsional and lateral stability which is very desirable in stepladder construction.

Subsequent to World War II, magnesium and aluminum stepladders became available for the household consumer and a wide variety of trade and other applcations. Magnesium was an excellent material because of its good strength and light volumetric weight making possible the utilization of heavy sections for strength as well the torsional stability. The preferred construction of both aluminum and magnesium stepladders was the use of rivets for joining siderails to front steps and rear siderails to cross braces. Resistance welding could have been utilized in the case of aluminum without appreciable loss of temper or strength, but its reliability is frequently questionable if not done under the right control conditions. The spot welds themselves are subject, under ladder service, to fatigue due to deflection of the components resulting in fatigue failure. Fusion welding could and was used in some cases for magnesium stepladders and was satisfactory, but all welding was too expensive in relation to riveted assemblies. Other rivet-type joints were achieved through the use of lugs in the step extrusions which extended through the siderail and were completed through rivet-like forming operations.

The riveted assembly of stepladders was not susceptible to automation and mechanization to the degree achieved in extension ladders and consequently, riveted stepladders retain a higher cost per pound or per foot of ladder. Riveted stepladders also, due to the light sections required for cost practicability, were easy to twist in torsion as well to deflect laterally under load. Furthermore, the joint itself all too frequently was made with small sized rivets for lower cost resulting in inadequate abuse and wear resistance, which in turn resulted in a lose or flimsey ladder after a short period of use. Furthermore, the use of riveted joints results in a human element in assembly which, if the operation is not properly performed, contributes to early ladder failure. Sometimes grommet type or hollow end rivets are used giving only minimum pressure and a poor joint at the interface between the ladder components and a very poor ladder serviceability. In many cases, the rivets themselves are made of a material lower in strength than the ladder components which, if small in size deform, reducing the serviceability and the resistance to torsion or deflection of the ladder through continued service. All too often bearing areas in riveted ladders are too small resulting in egg shaped rivet holes after a short period of service.

Aluminum alloys as used for ladders have a higher compressive yield strength than comparable magnesium alloys as well as higher tensile yield and ultimate tensile strength. They, consequently, can be used in thinner sections and are adaptable to a wider variety of fabrication methods. It so happens that these alloys are quite weldable although welding does soften the temper in the area immediately adjacent to the weld. However, this can be controlled and limited through speed of welding plus adjacent cooling and the use of welds in areas of minimum stress which would, of course, apply in ladder construction as the joint areas are areas of minimum beam or column stress. Resistance welding in aluminum is quite satisfactory and does not appreciably affect the temper if properly done, but requires very close process control. Nothing could be more embarrasing in ladder construction than to have resistance welds which were defective or uncompleted particularly as they cannot be seen from the exterior of the product.

Ladder designers and manufacturers have been continually searching for ways to fabricate ladders from aluminum or its alloys without use of rivets and similar fasteners and/or welding. A relatively early development in aluminum ladder construction employed lugs or studs on the ends of rungs or other cross members that extended through apertures in side rails with the lug or stud ends being pressed or crimped about the side rail apertures to fix the separate parts together (see U.S. Pat. Nos. 3,181,651 and 3,232,378). This basic idea was later used in one modified ladder construction (see U.S. Pat. No. 3,571,909) and in yet another modification with metal that could be welded (see U.S. Pat. No. 3,559,763).

Deforming of tabs, lugs or the like to provide interlocking between ladder parts has been employed in yet other ways. For example, tubular rungs have been joined to channel side rails by crimping portions of the rung ends, or sleeves surrounding the rungs, to the periphery of holes in the side rails (see U.S. Pat. No. 3,500,956; 3,528,525 and 3,638,759). Also, flat steps have been fixed to side rails in metal ladders by deforming flanges on the steps within grooves contained in the side rails (see U.S. Pat. No. 3,970,400).

The manufacture of extension ladders has reached an advanced art through the use of formed and pressed members that has achieved not only a good degree of automation and mechanization, but also stiffness, stability and safety, and good appearance. This has been achieved through the use of round and flat rungs of limited tread width. This has not been achieved in the wide tread extension ladders. The problem in all other cases of ladder construction is one of cost and lack of suseptibility to economical assembly methods.

In spite of the extensive development work and design improvements on metal ladder construction in the prior art, there has existed a need for improvements in the construction of ladders from metal sections without use of rivets or other fasteners and/or welding to provide interlocking between the major metal sections of the ladders. Such improvements, in order to be successful in the market place, would need to produce ladders without loss of strength or stability as compared to prior art ladders while reducing the parts and labor costs of manufacture. Since rivets or other fasteners would be eliminated, improvements in weight reduction would be expected if the other criteria would be met.

OBJECTS

A principal object of the present invention is the provsision of new improvements in the construction of metal ladders, particularly ladders made of extruded channels of aluminum metal alloy.

Further objects include the provision of:

1. New forms of interlocking between metal ladder parts for use with all types of ladders, particularly stepladders, extension ladders and combination ladders.
2. New methods for fabrication of ladders from extruded channels of aluminum metal alloy.
3. New forms of metal ladders wherein side rails and cross members are joined without use of rivets or other fasteners and/or welding.
4. New metal ladder manufacture methods that can be highly mechanized and accomplished with minimum labor.
5. An interlocking of the ladder components in a manner susceptible to a high degree of automation and mechanization with enough seating or bearing area to improve the load carrying ability of the joint to a substantial degree over riveted joints, to achieve enough points of retention to resist torsion or deflection or failure and provide the ultimately desirable product wherein minimum weight, maximum strength, stability and safety can be achieved while retaining good appearance and merchandising acceptability.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

These foregoing objects are accomplished according to the present invention by a new concept for interlocking separate parts of ladders made from channels of aluminum or other metals. In particular, the new interlocking technique is used to join ladder side rails to cross members, but it may be also used in joining other parts, e.g., slats of a bucket rack to support channels, bucket rack to rear side rail joints and interlocking in top plates, feet, bracing etc. The side rails can be of various types, e.g., part of either the front step section or rear prop section of a stepladder. Also the cross members may be varied, e.g., they may be flat steps of a stepladder, rungs of an extension ladder, braces in the rear prop section of a stepladder, etc.

Basically, the invention is used to join intersecting parts of a ladder made of metal channels. One of the intersecting channels is formed to comprise at least one pair of U-shaped cavities the openings of which face each other in a common plane. The other intersecting channel is formed to have a pair of tip flanges and portions of such tip flanges are fitted into the U-shaped cavities of the first channel. With the channels so positioned, portions of the first channel are press formed against the tip flanges to lock the second channel in the first channel.

This technique can be used to form some or all the joints between separate parts in a metal ladder.

The invention is particularly useful in joining metal side rails of a ladder to metal cross members extending between the side rails. In such constructions of the invention the side rails and cross members are channels, the channels of the cross members comprise tip flanges, the channels of the side rails comprise at least one pair of U-shaped cavities the openings of which face each other in a common plane, portions of the tip flanges are fitted into the cavities, and portions of the side rail channels are press formed against the tip flanges to lock the cross members in the side rails.

In preferred embodiments of ladders of the invention having at least one section formed of a pair of spaced apart, metal side rails and a plurality of spaced apart, metal cross members extending between said side rails, the improvements of the invention will comprise side rails that are channel members defined by a web portion and at least one lateral flange, cross members that are channel members defined by a central web and a pair of depending flanges, each of the depending flanges having an integral tip flange and integral lug intermediate the tip flange and the central web, the tip flanges and lugs extending outwardly from the depending flanges and parallel to the central web, the web portion of the side rail channel consists of a flat base, a pair of integral L-shaped lugs is at each side end of the flat base forming inside U-shaped cairities at each of the base, the width of said cavities being approximately equal to the distance between adjacent surfaces of the tip flange and lug of the cross member, the web portion of the side rails and the depending flanges of said cross members are slotted to enable the ends of said cross members to be interlocked with the side rails, and portions of the L-shaped lugs are press formed against tip flanges of the cross members to rigidly fix the cross members in the side rails.

BRIEF DESCRIPTION OF THE DRAWINGS

A more complete understanding of the invention may be had by reference to the accompanying drawings in which:

FIG. 1 is a perspective view of a stepladder constructed in accordance with the invention.

FIG. 2 is a fragmentary sectional view taken on the line 2—2 of FIG. 1.

FIG. 3 is a fragmentary sectional view taken on the line 3—3 of FIG. 2.

FIG. 4 is a fragmentary sectional view taken on the line 4—4 of FIG. 2.

FIG. 5 is a fragmentary sectional view taken on the line 5—5 of FIG. 2.

FIG. 6 is a fragmentary sectional view taken on the line 6—6 of FIG. 2.

FIG. 7 is a fragmentary sectional view taken on the line 7—7 of FIG. 2.

FIG. 8 is a fragmentary sectional view taken on the line 8—8 of FIG. 3.

FIG. 9 is a fragmentary sectional view taken on the line 9—9 of FIG. 3.

FIG. 10 is a fragmentary lateral view partially in section of a portion of a side rail of the front section of the ladder of FIG. 1 prior to insertion of a step.

FIG. 14 is a fragmentary plan view partially in section and partially broken away showing a step being inserted in the side rail shown in FIGS. 10 and 13.

FIG. 15 is a fragmentary lateral view partially in section showing a sequel to insertion of the step into the side rail as shown in FIG. 14.

FIG. 16 is a fragmentary isometric view of the top step section of the ladder of FIG. 1.

FIG. 17 is a fragmentary sectional view taken on the line 17—17 of FIG. 16.

FIG. 18 is a fragmentary sectional view taken on the line 18—18 of FIG. 1.

FIG. 19 is a fragmentary sectional view taken on the line 19—19 of FIG. 18.

FIG. 20 is a fragmentary sectional view taken on the line 20—20 of FIG. 19.

FIG. 21 is a fragmentary lateral view, partially broken away, showing assembly of a cross-member with a side rail of the rear section of the ladder of FIG. 1.

FIG. 22 is a fragmentary lateral view, partially broken away, showing a sequel to the assembly shown in FIG. 21.

FIG. 23 is a fragmentary sectional view taken on the line 23—23 of FIG. 22.

FIG. 24 is a fragmentary lateral view, paritally broken away, showing a sequel to the assembly shown in FIG. 22.

FIG. 25 is a lateral sectional view taken on the line 25—25 of FIG. 1.

FIG. 26 is a fragmentary and partially broken away view taken on the line 26—26 of FIG. 25.

FIG. 27 is an exploded view illustrating the method of assembly of parts to produce the structure shown in FIG. 26.

FIG. 28 is a sectional view taken on the line 28—28 of FIG. 25.

FIG. 29 is a fragmentary lateral view of a slat of the bucket rack before its assembly with a support channel as seen in FIG. 25.

FIG. 30 is a fragmentary sectional view taken on the line 30—30 of FIG. 25.

FIG. 31 is a fragmentary sectional view taken on the line 31—31 of FIG. 30.

FIG. 32 is a fragmentary sectional view similar to FIG. 2 showing a modification in the step attachment to a side rail in the front section of the ladder.

FIG. 33 is an exploded, fragmentary sectional view illustrating the assembly of parts to produce the structure of FIG. 32.

FIG. 34 is a fragmentary sectional view taken on the line 34—34 of FIG. 32.

FIG. 35 is a fragmentary sectional view similar to FIG. 19 showing a modification in the cross-member attachment to the side rail in the rear section of the ladder.

FIG. 36 is a fragmentary sectional view illustrating a step in the assembly of parts to produce the structure of FIG. 35.

FIG. 37 is an exploded, fragmentary sectional view illustrating the assembly of parts to produce a further modification of cross-member attachment to the side rail in the rear section of the ladder.

FIG. 38 is a fragmentary sectional view similar to FIG. 30 showing a modification in the attachment of the bucket rack bracket.

FIG. 39 is a lateral view taken on the line 39—39 of FIG. 38.

DESCRIPTION OF THE PREFERRED EMBODIMENTS

Figures 11, 12, 13, 40, 41:
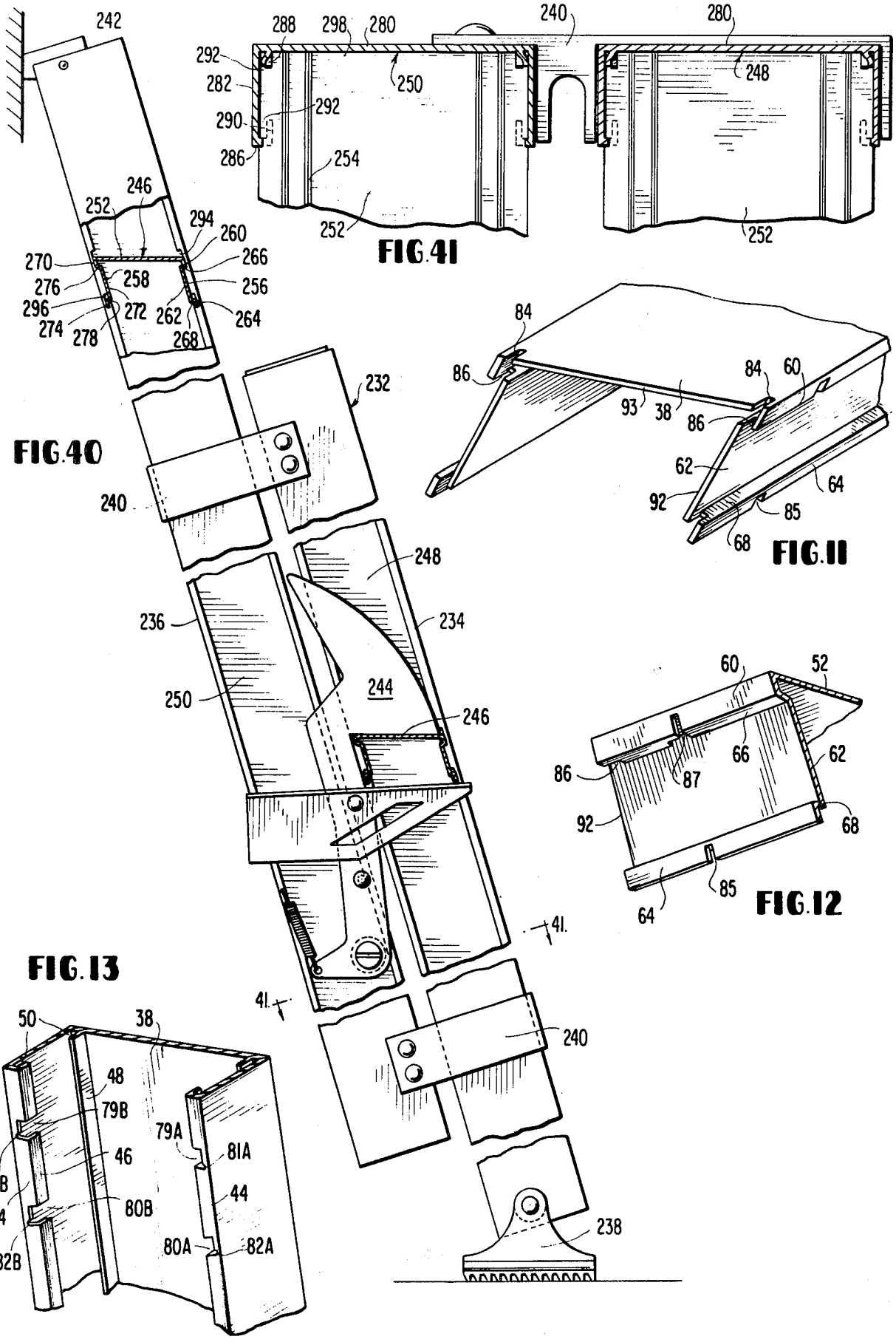
FIG. 11 is a fragmentary isometric end view of the ladder step before assembly with the side rail.
FIG. 12 is a fragmentary isometric side view of the ladder step as shown in FIG. 11.
FIG. 13 is a fragmentary isometric lateral view of a notched portion of the side rail before assembly into the ladder of FIG. 1.
FIG. 40 is a fragmentary view, partially broken away, of an extension ladder built in accordance with the present invention.
FIG. 41 is a fragmentary sectional view taken on the line 41—41 of FIG. 40.

Referring in detail to the drawings in which similar parts are identified by the same numeral, the stepladder 2 comprises a front section 4, a rear section 6 pivoted to the front section, a bucket rack 8 and spreader means 10.

The front section 4 is formed of a pair of side rails 12, a top step 14, a plurality of lower steps 16, brace members 18 and resilient foot pads 20.

The rear section 6 is formed of a pair of side rails 22, cross members 24 and foot pads 26.

The bucket rack comprises side channels 28, slats 30 and 32 and pivot member 33.

The spreader means 10 is of conventional design as are the brace members 18 and foot pads 20 and 26, so they are not features of the present invention. The brace members 18 are each fixed at their top end to bottom step 16 by a single rivet 34 and at their lower end by a pair of rivets 36 which also serve to fix the foot pads 20 to the side rails 12.

The side rails 12 are channels tht consist of a web portion 38, parallel lateral flanges 40 having on their free ends 42 integral, right-angled tip flanges 44. Short legs 46 are disposed inwardly in the direction of web 38 and lugs 48 are formed integral with the web 38 so that the legs 46 and lugs 48 form a pair of U-shaped cavities 50 the openings of which face each other in a common plane.

The steps 16 are channels that consist of a flat tread portion 52 bearing serrations 54, obliquely depending flange legs 56 and 58 at the front and rear thereof respectively. Advantageously, the flange legs are disposed at an angle of 73° to the tread portion 52. The front flange leg 56 comprises three primary sections, namely, an upper leg bar 60, main leg 62 and lower leg bar 64. The leg bars 60 and 64 are made integral with the main leg 62 via cross flanges 66 and 68. The rear flange leg 58 comprises three primary sections, namely, upper leg bar 70, main leg 72 and lower leg bar 74 which are made integral with one another by cross flanges 76 and 78. The cross flanges 66, 68, 76 and 78 create seats for interlock load-bearing purposes.

In order to form joints between the steps 16 and the side rails 12, two upper notches 79A and 79B and two lower notches 89A and 80B are cut in the tip flanges 44 of the side rails 12. FIG. 13 illustrates a preferred form of these notches which have nicks 81A, 81B, 82A and 82B formed therein. In notch 79A, all of the tip flange 44 is removed for a distance from the notch bottom equivalent to the length of the step leg bar 60 and all but 0.03 to 0.05 inch of its width for the remainder of the notch length which is slightly more than the length of leg bar 60. The leg 46 is notched away from the top of the notch area for the length of the narrowed area of the tip flange portion of notch 79A plus the thickness of step web 38. The rear top notch 79B has removed only slightly more than the leg bar 76 length plus the step web 38 thickness. A 0.30 to 0.50 inch wide portion of rear tip flange 44 is left at the upper portion of the notch 79B equivalent to slightly more than the length of the rear top leg bar 76 with the remainder notch to the tip flange with the nick 81B contoured to match the angle of the step web 38. The lower front and rear notches 82A and 82B respectively are of a length equivalent to the length of the front and rear step leg bars 64 and 74 respectively plus entry clearance.

The steps 16 are prepared for joining to the siderails 12 by notching slots 84 at each end thereof to align with and accommodate the lugs 48 of the siderails to their full length. Vertical notches 85 are slotted through the lower front and rear leg bars 64 and 74 to the underside of the lower flanges 68 and 78 to align with and straddle the front and rear tip flanges 44 at the lower end of bottom notches 80A and 80B of the siderails 12 and to allow the front and rear flanges 68 and 78 to rest on the tip flanges 46 and lugs 48 of the siderails 12. Similarly, the upper cross flange 66 has notch 86 to align with the flange leg 46. Notch 86 is sized to allow entry of the flange leg 46 projecting upward from the bottom of the upper front siderail notch 79A. The rear upper step leg bar 70 and flange 76 have notch 87 in alignment with and to accommodate the tip flange 44 and flange leg 46 at the lower end of the upper rear siderail notch 79B.

When the siderails and steps are properly notched, the step leg bars 60, 64, 70 and 74 may be inserted into the siderail notches (see FIG. 14) and moved downwardly (see FIG. 15) to allow the step flanges 66, 68, 76 and 78 to rest snugly against the bottom of notches 79A, 79B, 80A and 80B. The siderail lugs 48 are then press formed for a short distance below the lower leg bars 64 and 74 and immediately above the step web 52 in the direction of siderail flanges 40 providing ledges 90 against the underside of step leg bars 64 and 74 and tightly against the top ends of the upper step leg bars 60 and 70 securely locking the assembled parts together.

As an added feature to further enhance interlocking of the steps and siderails, serrations can be formed on the ends 92 of the step flanges 62 and ends 93 of webs 38.

The top step 14 of the ladder 2 comprises a tread portion 94 having a dished area 96, front and rear lateral flanges 98 and 100 respectively and side lateral flanges 102. The top step 14 is fastened to front section 4 by a pair of rivets 104 while the rear section 6 is pivoted on the top step 14 at each side by a single rivet 106. A rubber or plastic spacer 108 is positioned between top step flange 98 and side rail flange 40.

The ends 92 and 93 of steps 16 are cut so that they abut the inner surface of side rail webs 38 in the fully assembled position (see FIGS. 3, 4 and 9). Hence, the steps serve as trusses to prevent pantographing of the front section 4. A very rigid construction is obtained and at least sixteen rivets which would be used in conventional ladders to mount the steps 16 are eliminated.

The assembly of the rear section 6 from side rails 22 and cross members 24 without use of rivets or weldings is illustrated in FIGS. 17–23.

The side rails 22 are channels comprising a we 110, short end flange 111, lateral flange 112 having on its free end 114 an integral L-shaped tip flange 116 and a short lug 118 formed integral with the web 110. The leg 120 of tip flange 116 and lug 118 form a pair of U-shaped cavities 122 the openings of which face each other in a common plane.

The cross members 24 are channels that comprise a central web 124, lateral flanges 126, tip flanges 128 parallel to the web 124 and short lugs 130 spaced a distance from the tip flanges 128 approximtely equal to the width of the cavities 122.

The rear section 6 tapers slightly outwardly from top to bottom. In order that the ends 131 of cross members 24 will abut the inside surface of side rail web 110, the ends 131 are cut at a slight angle corresponding to the angle of taper of the rear section side rails 22.

In order to form rivetless joints between the side rails 22 and cross members 24, notches 132 and 134 are cut in the legs 120 and notches 136 and 138 are cut in the lugs 118 of the side rail channels. Also, slots 140 are cut in the tip flanges 128 and part way into the lateral flanges 126 of the cross member channels. Assembly of the parts then begins as shown in FIG. 21 by moving cross member 24 into position over the notches in the side rail 22. This brings the parts into the position shown in FIG. 22, whereupon the cross member 24 is moved in the direction of the arrow in FIG. 23 to assume the position seen in FIG. 22. Next, the cross member 24 is moved in the direction of the arrow in FIG. 24 so that the outside surface of lateral flange 126 abuts the bottom edges 142 and 144 of notches 134 and 138 respectively. Finally, portions of the side rails, e.g., portions 146 of leg 120 and portions 148 of lugs 118 of the side rail channels, are press formed against the tip flanges 128 of the cross member channels as shown in FIG. 19 to rigidly fix the cross members 24 in the side rails 22.

An alternative method of assembly of side rails to steps or cross members that does not involve notching of side rails can be used. To accomplish this, notches may be formed in the steps or cross members and these would then be slipped into place for assembly by feeding from an end of the side rails. Such a method will be described and illustrated below relative to the assembly of the bucket rack 8.

Since the ends 131 of the cross members 24 abut the webs 110 of the side rails, the rear section does not require angled truss members to prevent pantographing of the rear section 6.

The side channels 28 of the bucket rack 8 comprise a web 150, lateral flange 152, L-shaped tip flange 154 and lug 156 integral with the flange 152. The leg 158 of tip flange 154 and lug 156 form with the web 150 a pair of U-shaped cavities 160 the openings of which face each other in a common plane.

The bucket rack slats 30 and 32 are channels comprising a central web 162, parallel tabs 164 and 166, end flange 168 and integral internal flanges 170.

To assemble the bucket rack, slots 172 first are cut in the tabs 164 and 166 and also notches 174 and 176 in end flange 168 and notches 178 and 180 in the internal flanges 170. Then the slotted and notched slats 30 and 32 are slipped into the side channels 28 as indicated by the arrow in FIG. 27. The assembly of the bucket rack 8 is then completed as seen in FIG. 26 by press forming indentations 182 and 184 in the leg 158 of tip flange 154 and indentions 186 and 188 in the lug 156 to lock the slats 30 and 32 in the side channels 28.

The pivot members 33 for the bucket rack 8 comprise a cylinderical bearing portion 190, L-shaped integral flange 192 and integral foot portion 194. Slots 196 are cut in flange 192 adjacent foot 194 and cut-outs (not shown) are made in the side rails 22 similar to 134 and 138 of FIG. 21. This permits the foot 194 of members 33 to enter the cut-outs and then be moved to a position where indentions may be press formed in lugs 118 and legs 120 of side rails 22 to lock the members 33 in the side rails as shown in FIG. 29.

The bucket rack 8 is pivoted on members 33 by having the inner end 200 of bearing portion 190 extend through a hole in flange 152 of side channels 28. It swings from a lowered position as shown in FIG. 24 to a raised position (not shown) substantially parallel to the back section side rails 22.

In the front step modification shown in FIGS. 32–34, the structure of step 16 is the same as described with reference to FIG. 2, i.e., the difference is in the manner of locking the step 16 in the side rails 12.

In preparation for such step assembly, a slot 202 is cut in the tip flanges 44 and legs 46 and a rectangular portion 204 is cut out of the leg 46 of side rails 12. Also, slots 206 are cut in tip flanges 44 forming tabs 208 which are bent upwardly as shown in FIG. 33. The slotted step 16 is then inserted in the prepared side rail 12 as indicated by the arrow in FIG. 33. When fully inserted, the step 16 may be lowered relative to side rail 12 as shown in FIG. 34 and the tab 208 is press formed to bring it into a step locking position as shown in FIG. 32.

FIGS. 35 and 36 illustrate a modification to the interlocking of side rails 22 and cross members 24 in the rear section 6 of ladder 2. In comparison to the structure shown in FIG. 19, the side rails 22 have a single notch 210 cut in the lugs 118 of the side rail channels and a single notch 212 cut in the channel legs 120. The cross member 24 has slots 140 cut in tip flanges 128 and notches 216 and 218 cut in lateral flanges 126. The cross member 24 can then be inserted in the side rail 22 as shown in FIG. 36 and then moved in the direction of the arrow to assume a position relative to the side rail as shown in FIG. 35. Finally, indentions 220 and 222 are press formed in lugs 118 and legs 120 respectively to lock the members 24 in the side rails 22.

Another modification in the interlocking of cross members 24 in side rails 22 is illustrated in FIG. 37. As compared to the structure of FIGS. 35 and 36, the lugs 118 of side rails 22 are not notched. Instead, an entire section side channel leg 120 is cut away to form a notch 224 through which the notched and slotted end of member 24 may be inserted as indicated by the arrow in FIG. 37. When this is done, the member 24 may be moved longitudinally relative to side rail 22 similarly as described with reference to FIGS. 35 and 36. Final assembly is attained, again, by press forming indentations similar to 220 and 222 to lock the member 24 in the side rail 22.

In the various arrangements shown in FIGS. 35–37, it is apparent that the notches 216 and 218 permit the members 24 to clear the lugs 118 and legs 120 so that the members 24 may be moved out of the notched areas of the side rails 22 and assume a position as seen in FIG. 35.

A modification of the interlocking of bucket rack brackets 33 with side rails 22 is illustrated in FIGS. 38 and 39. The bracket 33 has slots 196 cut therein to enable it to slide past lugs 118 and legs 120 of the side rail channels. A cut 226 is made in side channel web 110 to enable portion 190 of bracket 33 to slightly displace a portion 228 of web 110 when bracket 33 is twisted slightly in side rail 22 so that the bracket 33 will assume a horizontal position in the ladder when set up for use as shown in FIG. 1. This, together with press formed indentations 230 serve to interlock the brackets 33 with the side rails 22.

The construction of an extension ladder incorporating the joining of steps to side rails without rivets or weldings in accordance with this invention is illustrated in FIGS. 40 and 41.

The extension ladder 232 comprises a lower section 234, upper section 236, pivoted foot pads 238, slide brackets 240, top pads 242 and step latch 244. All of these components, except for the assembly of the steps 246 in the side rails 248 and 250, are conventional and will not be described in detail.

The steps 246 are essentially the same of steps 16 of the stepladder 2. They are channel members comprising a tread or step portion 252 having separations 254, obliquely depending flange legs 256 and 258 disposed at an angle of about 73° to the tread portion 252. The front flange leg 256 comprises an upper leg bar 260, main leg 262 and lower leg bar 264. The leg bars 260 and 264 are made integral with the main leg 262 via cross flanges 266 and 268.

The rear flange leg 258 comprises an upper leg bar 270, main leg 272 and lower leg bar 274 which are made integral with one another by cross flanges 276 and 278.

Side rails 248 and 250 are both formed of the same extruded metal channels comprising web portion 280, parallel lateral flanges 282 having on their free ends 284 integral L-shaped tip flanges 286 and short lugs 288 formed integral with web portion 280. The legs 290 of tip flanges 286 and the lugs 288 form a pair of U-shaped cavities 292 the openings of which face each other in a common plane.

The side rails 248 and 250 have upper notches 294 and lower notches 296 cut in them at proper intervals along their length so that steps 246 may be inserted as described with reference to FIGS. 8–15. The steps 246 are locked into the side rails 248 and 250 by press forming portions of lugs 288 and legs 290 to create indentations therein above and below each of the steps 246. As can be seen in FIG. 41, the ends 298 of the steps 246 abut the inner surface of channel webs 280 producing a strong ladder construction that prevents bending and twisting in the ladder sections without the use of angled truss members. The strength and rigidity of the new ladder assemblies, in their various forms, is equal to or greater than riveted or welded construction and the cost of manufacture is reduced by eliminating a multitude of rivets or welded joints. Furthermore, the new joint structures of the invention can be used in construction of other items than ladders, e.g., scaffolds, truss units, beams, pallets and the like.

The embodiments of the invention in which an exclusive property or provilege is claimed are defined as follows:

1. In a ladder having at least one section formed of a pair of spaced apart, metal side rails and a plurality of spaced apart, metal steps extending between said side rails, the improvements comprising:

said side rails are channel members defined by a web portion and a pair of lateral flanges, said steps are channel members defined by a central web and a pair of depending flanges, each said depending flange having an integral offset tip portion and an integral offset portion intermediate said depending flange and said central web, said offset portions extending outwardly from said depending flanges and parallel thereto, said web portion of said side rail channel consisting of a flat base, a pair of integral L-shaped flanges at each end of said lateral flanges forming inside U-shaped cavities at each side of said channel, the width of said cavities being approximately equal to the width of said offset portions of said steps, said web portion of said side rails and said depending flanges of said cross members being slotted to enable the ends of said cross members to be interlocked with said side rails, and portions of said L-shaped flanges being crimped against tip flanges of said steps to rigidly fix said steps in said side rails.

2. In a ladder made of light metal comprising first sections of metal channel that intersect second sections of metal channel, the improvements comprising:

said first channel sections comprising a web portion, at least one lateral flange, and at least one pair of U-shaped cavities in said flange the openings of which face each other in a common plane, said second channel sections comprising a central web and a pair of tip flanges, portions of said tip flanges are fitted into said cavities, and portions of said first channels are press formed against said tip flanges to lock the first and second channel section together.

3. The ladder of claim 2 wherein notches are formed in said lateral flange to permit said second channel section to be inserted therein so that said tip flanges fit into said cavities.

4. The ladder of claim 3 wherein said notches are contoured and have nick portions therein into which portions of said second channel sections protrude to enhance interlocking of said first sections with said second sections.

5. A ladder of claim 2 wherein said first channel sections are side rails of the ladder, said second channel members are step members spaced apart along said side rails and said tip flanges are leg bars formed as integral parts of said step members.

6. In a ladder having at least one section formed of a pair of spaced apart, metal side rails and a plurality of spaced apart, metal cross members extending between said side rails, the improvements comprising:

said side rails and cross members are channels, the channels of said cross members comprise tip flanges, the channels of said side rails comprise at least one pair of U-shaped cavities the openings of which face each other in a common plane, portions of said tip flanges are fitted into said cavities, said cross members and said side rail channels have cuts therein to enable said tip flanges to be fitted into said cavities, and portions of said side rail channels are press formed against said tip flanges to lock said cross members in said side rails.

7. A ladder of claim 6 which is a stepladder in which said one section is the rear group section of the ladder.

8. A ladder of claim 7 wherein said stepladder comprises a front step section formed with side rails and cross members fixed together as stated for said at least one section, the cross members of said front step section being steps.

9. The stepladder of claim 8 wherein the side rails of said front step section comprise a face web and a lateral flange at each side thereof, each of said lateral flanges comprising a pair of said U-shaped cavities and said steps comprise a flat step portion with a depending flange leg at the front and rear thereof, each of said flange legs comprising tip flanges portions of which are fixed into said cavities in the manner defined in claim 6.

10. A ladder of claim 6 which is an extension ladder having two sections each comprising side rails and cross members fixed together as defined in claim 6, said cross members being rungs of the extension ladder.

* * * * *